United States Patent [19]

Masterton et al.

[11] Patent Number: 4,665,339

[45] Date of Patent: May 12, 1987

[54] COLOR PICTURE TUBE HAVING IMPROVED SLIT COLUMN PATTERN

[75] Inventors: Walter D. Masterton, Manheim Township; Andrew Good, East Cocalico Township, both of Lancaster County, Pa.

[73] Assignee: RCA Corporation, Princeton, N.J.

[21] Appl. No.: 811,316

[22] Filed: Dec. 19, 1985

Related U.S. Application Data

[63] Continuation-in-part of Ser. No. 614,311, May 25, 1984, abandoned.

[51] Int. Cl.[4] ..... H01J 29/07

[52] U.S. Cl. ..... 313/403; 313/408

[58] Field of Search ..... 313/402, 403, 408

[56] References Cited

U.S. PATENT DOCUMENTS

| | | | |
|---|---|---|---|
| 3,686,525 | 8/1972 | Naruse et al. | 313/402 |
| 3,889,145 | 6/1975 | Suzuki et al. | 313/408 |
| 3,925,700 | 12/1975 | Saito | 313/403 |
| 3,947,718 | 3/1976 | van Lent | 313/408 |
| 4,136,300 | 1/1979 | Morrell | 313/403 |
| 4,162,421 | 7/1979 | Morrell | 313/403 |
| 4,300,069 | 11/1981 | Nolan | 313/403 |
| 4,303,466 | 12/1981 | Thoms | 156/626 |
| 4,429,028 | 1/1984 | Kuzminski | 430/5 |

FOREIGN PATENT DOCUMENTS

| | | | |
|---|---|---|---|
| 57-23446 | 2/1982 | Japan | 313/402 |
| 1310366 | 3/1973 | United Kingdom . | |
| 1316624 | 5/1973 | United Kingdom . | |
| 1348677 | 3/1974 | United Kingdom . | |

*Primary Examiner*—Palmer C. DeMeo
*Assistant Examiner*—K. Wieder
*Attorney, Agent, or Firm*—Eugene M. Whitacre; Dennis H. Irlbeck

[57] ABSTRACT

The present invention provides an improvement in color picture tubes having slit type apertured shadow masks wherein the aperture throats are arranged in columns, and the apertures within each column are separated by webs. The improvement comprises the aperture throat columns passing through a center portion of the mask being substantially straight, and the aperture throat columns on both sides of the center portion of the mask being convexly curved toward the center portion and increasing in curvature with distance from the center portion.

5 Claims, 7 Drawing Figures

COLOR PICTURE TUBE HAVING IMPROVED SLIT COLUMN PATTERN

This is a continuation-in-part of application Ser. No. 614,311, filed May 25, 1984, now abandoned.

This invention relates to color picture tubes having cathodoluminescent line screens and slit type shadow masks therein, and particularly to an improved pattern of slit columns in the shadow masks of such tubes.

BACKGROUND OF THE INVENTION

Most color picture tubes presently being manufactured are of the line screen-slit mask type. These tubes have spherically contoured faceplates with line screens of cathodoluminescent materials thereon and somewhat spherically contoured slit-apertured shadow masks adjacent to the screens. A screen 10 and a shadow mask 12 of an early type of line screen-slit mask tube are shown in FIGS. 1 and 2, respectively. In this type, the screen 10 is formed with curved sides 14, rounded corners 16 and straight vertical lines 18. The shadow mask 12 includes slit apertures 20 arranged in straight vertical columns 22. The screen is formed utilizing a photographic technique that uses a line light source for exposure and the shadow mask as a photographic master. Because of the generally spherical shape of the shadow mask 12, the off-axis slit apertures do not parallel the line light source during screening. This nonparallelism results in the formation of jagged phosphor lines on the screen. Such jagged lines are undesirable.

One technique used to overcome this problem of jagged screen lines is illustrated in FIGS. 3 and 4. A screen 24 is formed with bowed lines 26 as shown in FIG. 3. Such bowing is concave toward the vertical axis Y—Y, with the curvature of the screen lines increasing with increasing distance from the vertical axis Y—Y. In the corresponding shadow mask 28, the aperture columns 30 are similarly bowed concavely toward the vertical axis Y—Y, as shown in FIG. 4. Because of this bowing of the aperture columns 30, the longitudinal axes of the slit apertures 32 that are off the major axis X—X and off the minor axis Y—Y are closer to parallelism with the line light source during screening. Thus the bowed lines 26 are smoother than are the lines of the embodiment of FIG. 1. Patents illustrative of this bowed screen line and bowed aperture column concept are: U.S. Pat. No. 3,889,145, issued to Suzuki et al. on June 10, 1975; U.S. Pat. No. 3,925,700, issued to Saito on Dec. 9, 1975; and U.S. Pat. No. 3,947,718, issued to van Lent on Mar. 30, 1976.

Recently, several color picture tube modifications have been suggested. One of these modifications is to decrease the curvatures of the faceplate and shadow mask and to square-off the viewing screen, so that the peripheral borders have straight sides and the corners are substantially square. In another modification, the curvatures of the faceplate and shadow mask remain unchanged, but the peripheral border of the screen is changed to square-off the corners of the screen.

In these modified tubes, it is desirable to obtain substantially straight lines in all portions of the screen, and it is particularly desirable to form straight lines at the sides of the screen. In some of the abovementioned tube modifications, however, it is impossible to obtain straight lines at the screen sides by utilizing conventional construction designs and techniques. The present invention provides a solution to this problem by utilizing an improved novel pattern of slit columns in the shadow masks of such tubes.

SUMMARY OF THE INVENTION

The present invention provides an improvement in color picture tubes having slit type apertured shadow masks wherein the slit apertures are arranged in columns, and the apertures within each column are separated by webs. The improvement comprises the aperture columns passing through a center portion of the mask being substantially straight, and the aperture columns on both sides of the center portion of the mask being convexly curved toward the center portion and increasing in curvature with distance from the center portion.

BRIEF DESCRIPTION OF THE PREFERRED EMBODIMENT

Figure 1:
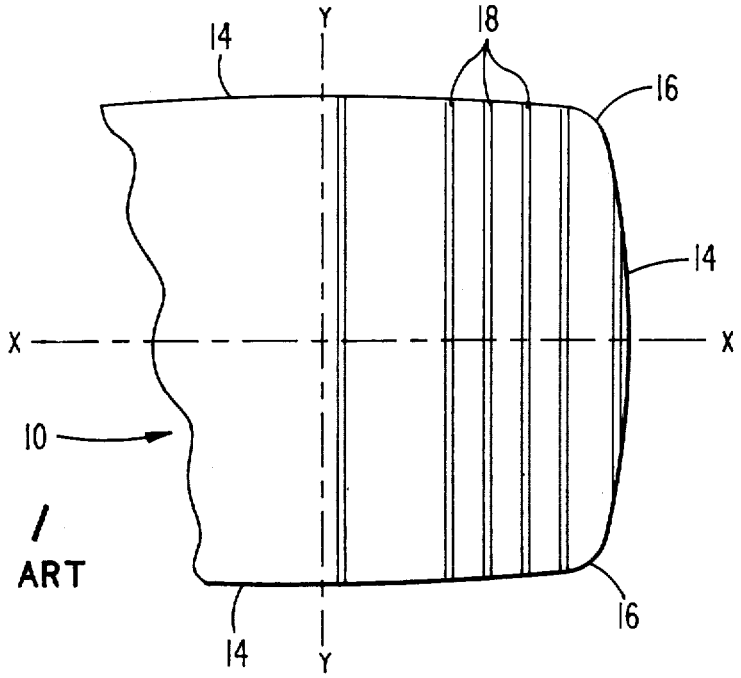
Fig. 1 PRIOR ART
FIG. 1 is a fragmentary elevational view of a prior art viewing screen.
Figure 2:
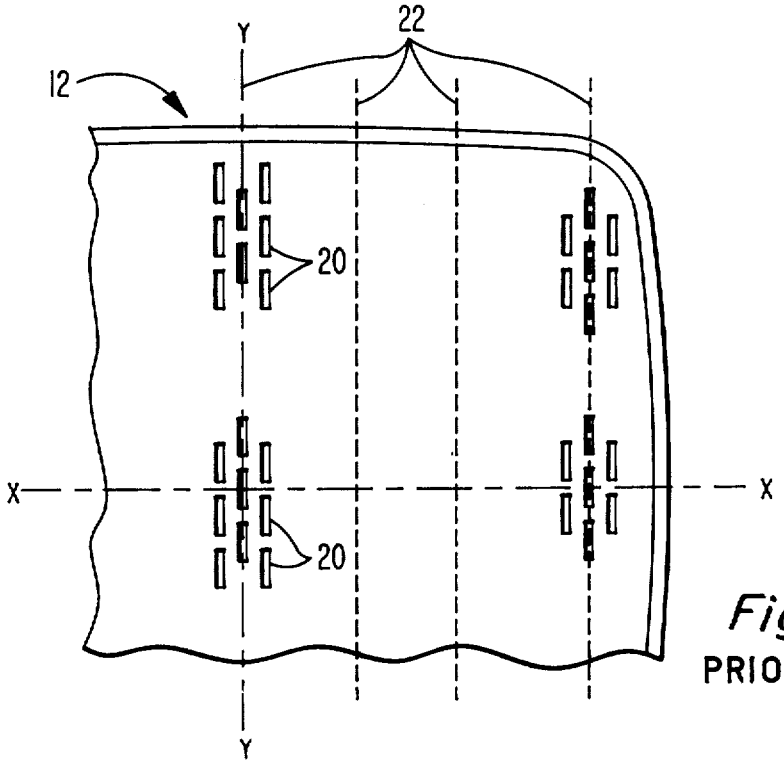
Fig. 2 PRIOR ART
FIG. 2 is a fragmentary elevational view of a prior art shadow mask associated with the screen of FIG. 1.
Figure 3:
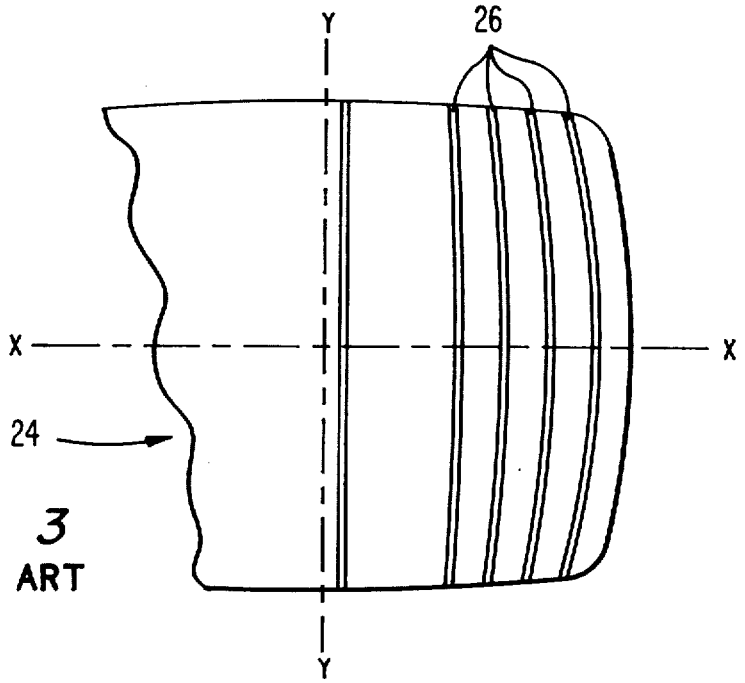
Fig. 3 PRIOR ART
FIG. 3 is a fragmentary elevational view of another prior art viewing screen.
Figure 4:
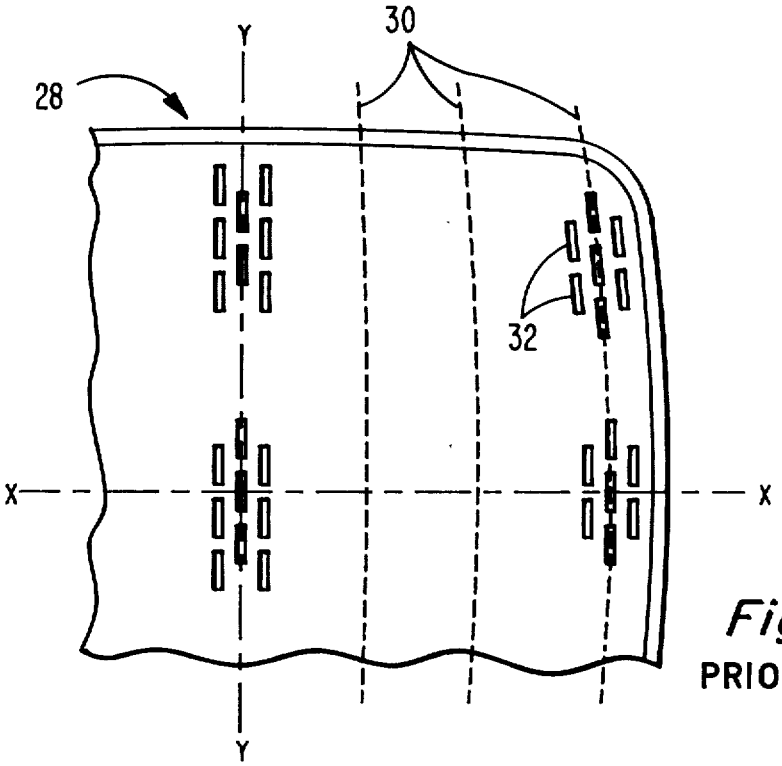
Fig. 4 PRIOR ART
FIG. 4 is a fragmentary elevational view of another prior art shadow mask associated with the screen of FIG. 3.
Figure 5:
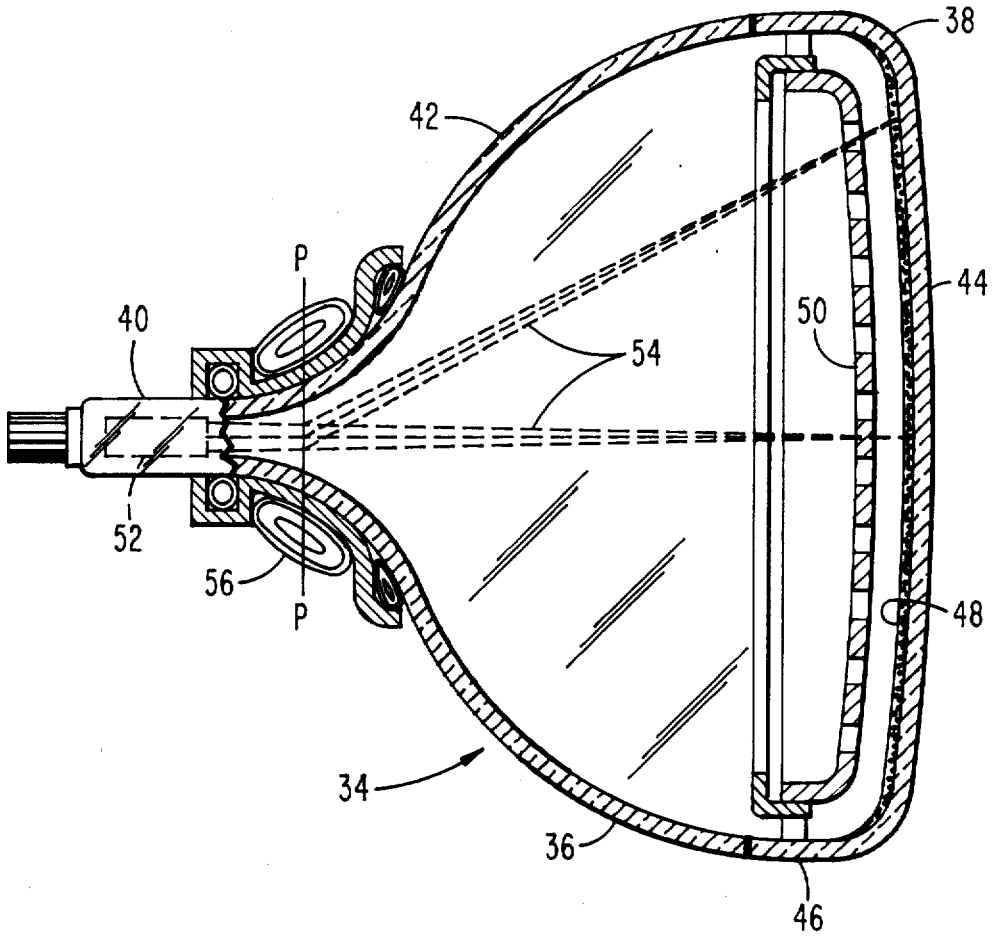
FIG. 5 is a plan view, partly in axial section, of a shadow mask color picture tube embodying the present invention.

FIG. 5 is a plan view of a rectangular color picture tube 34 having a glass envelope 36 comprising a rectangular faceplate panel 38 and a tubular neck 40 connected by a rectangular funnel 42. The panel 38 comprises a viewing faceplate 44 and peripheral sidewall 46, the distal edge of which is sealed to the funnel 42. A three-color phosphor screen 48 is located on the inner surface of the faceplate 44. The screen 48 is a line screen with the phosphor lines extending substantially perpendicular to the high frequency raster line scan of the tube (i.e., normal to the plane of FIG. 5). A multi-apertured color selection electrode or shadow mask 50 is removably mounted, by conventional means, in predetermined space relation to the screen 48. An inline electron gun 52, shown schematically by dotted lines in FIG. 5, is centrally mounted within the neck 40 to generate and direct three electron beams 54 along coplanar convergent paths through the mask 50 to the screen 48.

The tube of FIG. 5 is designed to be used with an external magnetic deflection yoke, such as the yoke 56 schematically shown surrounding the neck 40 and funnel 42 in the neighborhood of their junction. When activated, the yoke 56 subjects the three beams 54 to magnetic fields which cause the beams to scan horizontally and vertically in a rectangular raster over the screen 48. The initial plane of deflection (at zero deflection) is shown by the line P—P in FIG. 5 at about the middle of the yoke 56. Because of fringe fields, the zone of deflection of the tube extends axially, from the yoke 56 into the region of the gun 52. For simplicity, the actual curvature of the deflected beam paths in the deflection zone is not shown in FIG. 5.

Figure 6:
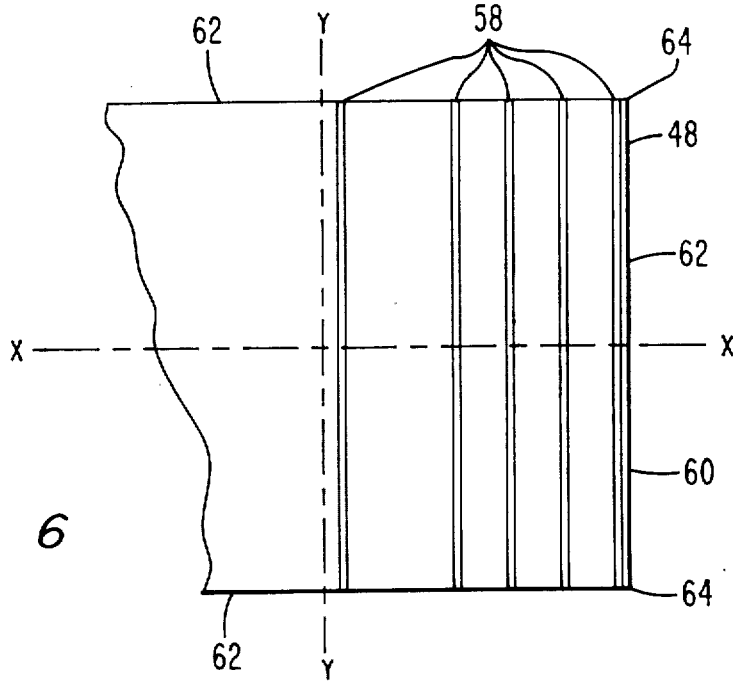
FIG. 6 is a fragmentary elevational view of the viewing screen of the tube of FIG. 5, showing an enlargement of some of the phosphor lines of the screen.

The screen 48 of the tube 34 comprises an array of straight parallel vertical phosphor lines 58, only selected ones of which are shown in FIG. 6. The phosphor lines 58 are grouped in triads of red-, green-, and blue-emitting phosphors. The phosphor lines of each triad and the triads themselves may be separated from each other by areas of light-absorbing materials. The peripheral border 60 of the screen 48 has straight sides 62 and square corners 64, and is substantially rectangular.

Figure 7:
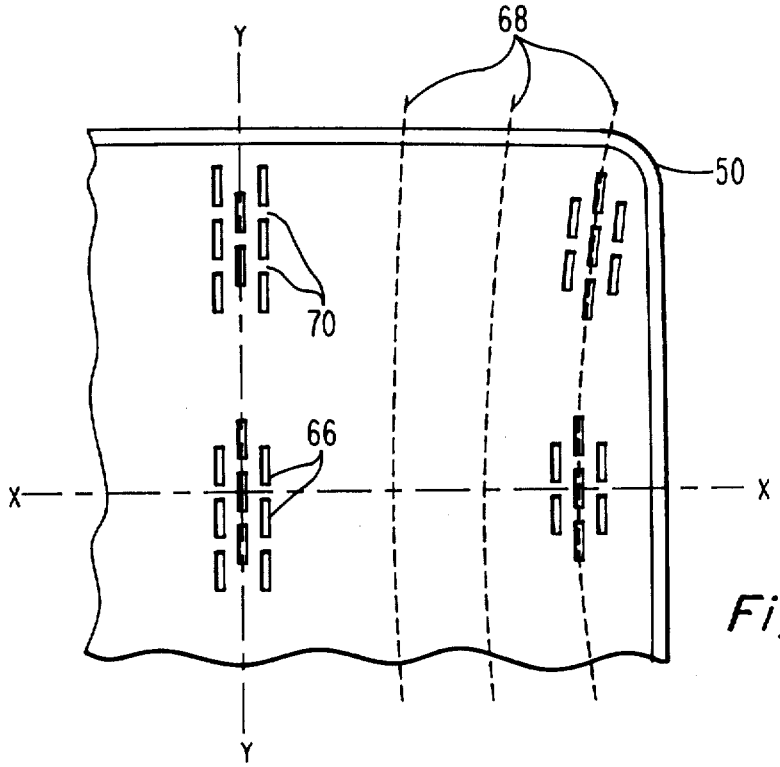
FIG. 7 is a fragmentary elevational view of the shadow mask of the tube of FIG. 5, showing an enlargement of some of the apertures in the mask.

The shadow mask 50 of the tube 34 is shown in FIG. 7. The mask 50 includes an array of elongated slot or slit-shaped apertures 66. On one surface of the mask 50, the apertures 66 have a large opening, and on the other surface, they have a smaller opening. The narrowest restriction in an aperture, called the slit or throat, is very close to the mask surface having the smaller opening. The apertures 66 are formed by coating both sides of the mask material with a photoresist and then by exposing both sides through photomasters having related aperture patterns. Thereafter, the photoresist is developed, and the apertures are etched through the mask from both sides. The aperture pattern on one photomaster has aperture shapes much wider than the aperture shapes on the other photomaster, thereby permitting the formation of the larger openings on the one surface than on the other surface of the mask. Because the aperture throats form near the surface of the mask having the smaller aperture openings, the sizes and locations of the throats are closely related to the size and locations of the narrower photomaster patterns. The formation of a shadow mask utilizing two aperture patterns is well known as is evidenced by U.S. Pat. No. 4,293,792 issued to Roberts on Oct. 6, 1981, U.S. Pat. No. 4,300,069 issued to Nolan on Nov. 10, 1981, and U.S. Pat. No. 4,429,028 issued to Kuzminski on Jan. 31, 1984. These patents are hereby incorporated by reference for their teaching of shadow mask construction.

The aperture throats are arranged in columns 68 and are vertically separated from each other by bridges or web portions 70 of the mask 50. The aperture throats in each column 68 are vertically staggered with respect to the aperture throats in adjacent columns. The aperture throat columns 68 in a center portion of the mask 50 are straight. The aperture throat columns 68 on both sides of the center portion of the mask are convexly curved toward the center portion. The curvature of these off-center columns increases with increasing distance from the center portion of the mask 50.

Given the screen surface contour and the definition of the last line desired at the screen sides, the position and shape of the last column of aperture throats on the formed shadow masks will be determined by the contour of the shadow mask itself and its relative position to the screen. These, in turn, are a function of the separation of adjacent aperture throat columns chosen on the basis of screen resolution requirements, and the relative spacing of the red, green and blue electron beam spots corresponding to a particular mask aperture. The latter is, in turn, a function of the gradient in the particular deflection field used. In addition, the effects of the mask forming operation on the shape and position of the aperture throat columns must be taken into account when specifying the aperture columns for the unformed aperture mask.

The technique utilized to determine the position and shape of the aperture throat columns desired in an unformed flat mask is as follows. First, the number of x, y positions on the screen corresponding to points on the desired last line is specified. Next, the appropriate center of deflection for the system is specified. Then, the intercepts with the formed mask surface are calculated for lines from the deflection center to the specified screen points. The x, y positions thus computed for the points on the shadow mask are then modified by the subtraction of the x, y changes expected during the mask forming operation. This results in a set of x, y positions which, when connected smoothly by a spline or other mathematical smoothing means, define a curve for the desired last line of aperture throats in the unformed mask. Such a curve, for an embodiment of the present invention, is inwardly convex. Because of this convex curvature, the aperture throat column-to-column spacing, measured centerline-to-centerline, also called the a-spacing, generally increases with increasing distance from the major axis, X—X.

EXAMPLE

Tables I, II and II present construction data for a novel shadow mask for use in an improved color picture tube. All of the included data is for a flat mask before contouring. Therefore, resultant values in a formed mask will vary to some extent depending on the many possible variables occurring during forming. Each of the tables represents information for one quadrant of a mask. The left columns are distances along the Y-axis from the X-axis. The bottom rows are distances along the X-axis from the Y-axis. The top rows are Y distances at the ends of the aperture throat columns. The right column represents X distances for the last aperture throat column. Table I presents the aperture throat widths throughout the quadrant. Table II presents the vertical tie bar or web dimensions between adjacent slit apertures within an aperture column. Table III presents the horizontal spacing (a-spacing) between the centerlines of adjacent aperture throat columns. It can be seen in Table III that the aperture throat columns are convexly curved inwardly and that the curvature of the columns increases with increasing distance from the minor axis.

TABLE I

| | SLIT WIDTH IN MILS @ Y = | | | | | | | | | | |
|---|---|---|---|---|---|---|---|---|---|---|---|
| | 7.329 | 7.327 | 7.322 | 7.314 | 7.302 | 7.287 | 7.269 | 7.247 | 7.222 | 7.194 | 7.174 |
| | 6.73 | 6.73 | 6.76 | 6.81 | 6.89 | 7.00 | 7.11 | 7.21 | 7.38 | 7.66 | 7.64 (@X = 9.642) |
| Y inches | | | | | | | | | | | |
| 7.0 | 6.74 | 6.74 | 6.77 | 6.81 | 6.90 | 7.02 | 7.12 | 7.22 | 7.44 | 7.65 | 7.32 (@X = 9.638) |
| 6.0 | 6.75 | 6.76 | 6.79 | 6.84 | 6.91 | 7.00 | 7.11 | 7.24 | 7.43 | 7.53 | 7.33 (@X = 9.603) |
| 5.0 | 6.78 | 6.79 | 6.81 | 6.86 | 6.92 | 7.01 | 7.11 | 7.24 | 7.40 | 7.53 | 7.52 (@X = 9.577) |
| 4.0 | 6.85 | 6.85 | 6.86 | 6.90 | 6.96 | 7.04 | 7.13 | 7.25 | 7.40 | 7.53 | 7.48 (@X = 9.559) |
| 3.0 | 6.92 | 6.92 | 6.93 | 6.96 | 7.00 | 7.06 | 7.15 | 7.25 | 7.40 | 7.51 | 7.46 (@X = 9.547) |
| 2.0 | 6.99 | 6.99 | 7.00 | 7.01 | 7.04 | 7.09 | 7.16 | 7.26 | 7.39 | 7.50 | 7.50 (@X = 9.540) |
| 1.0 | 7.06 | 7.05 | 7.04 | 7.04 | 7.06 | 7.10 | 7.17 | 7.27 | 7.40 | 7.52 | 7.53 (@X = 9.536) |

TABLE I-continued

| | SLIT WIDTH IN MILS @ Y = | | | | | | | | | | |
|---|---|---|---|---|---|---|---|---|---|---|---|
| | 7.329 | 7.327 | 7.322 | 7.314 | 7.302 | 7.287 | 7.269 | 7.247 | 7.222 | 7.194 | 7.174 |
| 0.0 | 7.11 | 7.07 | 7.05 | 7.05 | 7.07 | 7.11 | 7.17 | 7.27 | 7.40 | 7.54 | 7.54 (@X = 9.535) |
| | 0.0 | 1.0 | 2.0 | 3.0 | 4.0 | 5.0 | 6.0 | 7.0 | 7.0 | 9.0 | |
| | | | | | X inches | | | | | | |

TABLE II

| | TIE BAR IN MILS @ Y = | | | | | | | | | | |
|---|---|---|---|---|---|---|---|---|---|---|---|
| | 7.329 | 7.327 | 7.322 | 7.314 | 7.302 | 7.287 | 7.269 | 7.247 | 7.222 | 7.194 | 7.174 |
| | 5.66 | 5.67 | 5.69 | 5.72 | 5.75 | 5.80 | 5.85 | 5.91 | 5.98 | 6.04 | 6.09 (@X = 9.642) |
| Y inches | | | | | | | | | | | |
| 7.0 | 5.63 | 5.64 | 5.66 | 5.69 | 5.73 | 5.78 | 5.83 | 5.90 | 5.96 | 6.03 | 6.08 (@X = 9.638) |
| 6.0 | 5.54 | 5.55 | 5.57 | 5.61 | 5.65 | 5.71 | 5.77 | 5.83 | 5.91 | 5.98 | 6.03 (@X = 9.603) |
| 5.0 | 5.45 | 5.46 | 5.49 | 5.53 | 5.58 | 5.64 | 5.71 | 5.78 | 5.85 | 5.93 | 5.98 (@X = 9.577) |
| 4.0 | 5.36 | 5.37 | 5.41 | 5.45 | 5.51 | 5.58 | 5.65 | 5.73 | 5.81 | 5.89 | 5.94 (@X = 9.559) |
| 3.0 | 5.27 | 5.29 | 5.33 | 5.38 | 5.45 | 5.53 | 5.61 | 5.69 | 5.77 | 5.86 | 5.91 (@X = 9.547) |
| 2.0 | 5.18 | 5.20 | 5.26 | 5.33 | 5.41 | 5.49 | 5.57 | 5.66 | 5.75 | 5.83 | 5.88 (@X = 9.540) |
| 1.0 | 5.09 | 5.13 | 5.20 | 5.29 | 5.37 | 5.46 | 5.55 | 5.64 | 5.73 | 5.82 | 5.87 (@X = 9.536) |
| 0.0 | 5.00 | 5.09 | 5.18 | 5.27 | 5.36 | 5.45 | 5.54 | 5.63 | 5.72 | 5.82 | 5.86 (@X = 9.535) |
| | 0.0 | 1.0 | 2.0 | 3.0 | 4.0 | 5.0 | 6.0 | 7.0 | 7.0 | 9.0 | |
| | | | | | X inches | | | | | | |

TABLE III

| | HORIZONTAL "A" IN MILS @ Y = | | | | | | | | | | |
|---|---|---|---|---|---|---|---|---|---|---|---|
| | 7.329 | 7.327 | 7.322 | 7.314 | 7.302 | 7.287 | 7.269 | 7.247 | 7.222 | 7.194 | 7.174 |
| | 30.00 | 30.07 | 30.29 | 30.66 | 31.18 | 31.85 | 32.68 | 33.64 | 34.77 | 36.06 | 37.01 (@X = 9.642) |
| Y inches | | | | | | | | | | | |
| 7.0 | 30.00 | 30.07 | 30.29 | 30.65 | 31.16 | 31.81 | 32.64 | 33.59 | 34.71 | 35.99 | 36.88 (@X = 9.638) |
| 6.0 | 29.99 | 30.07 | 30.27 | 30.62 | 31.10 | 31.72 | 32.50 | 33.39 | 34.45 | 35.65 | 36.44 (@X = 9.603) |
| 5.0 | 30.00 | 30.06 | 30.26 | 30.59 | 31.05 | 31.65 | 32.40 | 33.25 | 34.25 | 35.40 | 36.15 (@X = 9.577) |
| 4.0 | 30.00 | 30.06 | 30.25 | 30.58 | 31.02 | 31.60 | 32.32 | 33.15 | 34.12 | 35.22 | 35.90 (@X = 9.559) |
| 3.0 | 30.00 | 30.06 | 30.25 | 30.57 | 31.00 | 31.57 | 32.27 | 33.08 | 34.03 | 35.11 | 35.77 (@X = 9.547) |
| 2.0 | 30.00 | 30.06 | 30.25 | 30.56 | 30.99 | 31.55 | 32.25 | 33.04 | 33.98 | 35.04 | 35.69 (@X = 9.540) |
| 1.0 | 30.00 | 30.06 | 30.24 | 30.55 | 30.98 | 31.53 | 32.23 | 33.02 | 33.95 | 35.00 | 35.64 (@X = 9.536) |
| 0.0 | 30.00 | 30.06 | 30.24 | 30.55 | 30.98 | 31.53 | 32.22 | 33.01 | 33.94 | 34.98 | 35.63 (@X = 9.535) |
| | 0.0 | 1.0 | 2.0 | 3.0 | 4.0 | 5.0 | 6.0 | 7.0 | 7.0 | 9.0 | |
| | | | | | X inches | | | | | | |

The flat mask, constructed in accordance with the preceding tables, is contoured to have an approximate major axis radius of 32.5 inches (82.6 cm) and an approximate minor axis radius of 42.6 inches (108.2 cm). The contoured mask is used with a tube having a 26 inch (66.04 cm) diagonal viewing screen and which has a faceplate outside of approximately 42.4 inches (107.7 cm) and a faceplate inside radius of approximately 40.7 inches (103.4 cm).

Table IV provides a comparison of the last aperture throat columns of the novel shadow mask as defined in the foregoing tables with a conventional slit apertured shadow mask for use in a tube having a 25 inch (62.5 cm) diagonal viewing screen.

TABLE IV

| | Conventional Mask | | Novel Mask | |
|---|---|---|---|---|
| Y (Inches) | X (Inches) | a-spacing (Mils) | X (Inches) | a-spacing Mils |
| 0 | 9.645 | 39.52 | 9.535 | 35.63 |
| 1.0 | 9.650 | 39.61 | 9.536 | 35.64 |
| 2.0 | 9.652 | 39.64 | 9.540 | 35.69 |
| 3.0 | 9.645 | 39.52 | 9.547 | 35.77 |
| 4.0 | 9.628 | 39.32 | 9.559 | 35.90 |
| 5.0 | 9.604 | 39.03 | 9.577 | 36.15 |
| 6.0 | 9.562 | 38.53 | 9.603 | 36.44 |
| 7.0 | 8.979 | 36.89 | 9.638 | 36.88 |

As can be seen from the second column in Table IV, the last aperture throat column of the conventional mask starts at 9.645 inches at the major axis (Y=0) and gradually curves inwardly as distance from the major axis increases to equal 8.979 inches at Y=7 inches. Such curvature appears as a convex outwardly bowing in the aperture columns at the sides of the mask. In the novel mask, however, the last aperture throat column begins at 9.535 inches on the major axis and gradually increases in distance from the Y-axis with increasing distance from the major axis to equal 9.638 at Y=7 inches. Such curvature appears as a concave inwardly having the aperture throat columns at the sides of the novel mask.

The a-spacing variation in the conventional mask between the last two adjacent aperture throat columns at the sides of the mask start at 39.52 mils at the major axis and gradually converge to a spacing of 36.89 mils at the Y=7 inches location. The a-spacing of the novel mask begins at an a-spacing of 35.63 mils on the major axis and increases with increasing distance from the major axis to 36.88 mils at Y=7 inches.

What is claimed is:

1. In a color picture tube having a slit type apertured mask, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, said columns extending vertically when said tube is in an operational orientation, the improvement comprising the aperture throat columns passing through a center portion of said mask being substantially straight and the aperture throat columns on both sides of the center portion of the mask being convexly curved toward said center portion and increasing in curvature with increasing distance from the center portion.

2. The tube as defined in claim 1, wherein said tube has a line type phosphor screen, and all of the lines of said screen are substantially straight and substantially parallel to each other.

3. The tube as defined in claim 1, wherein the center-to-center spacing between the last two aperture throat columns at a side of said mask increases with increasing distance from a central axis of said mask.

4. In a color picture tube having a slit type apertured mask having a major axis and a minor axis, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, the improvement comprising the aperture throat columns passing through a center portion of said mask being substantially straight and substantially parallel to the minor axis and the ultimate aperture throat columns at the sides of the mask are curved being closer to the minor axis where they cross the major axis than they are at their ends.

5. In a color picture tube having a slit type apertured mask having a major axis and a minor axis, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, the improvement comprising the centerline-to-centerline spacing between the last two adjacent aperture throat columns at a side of the mask being less where the columns cross the major axis than at their ends.

* * * * *

UNITED STATES PATENT AND TRADEMARK OFFICE
CERTIFICATE OF CORRECTION

PATENT NO. : 4,665,339

DATED : May 12, 1987

INVENTOR(S) : Walter David Masterton et al.

It is certified that error appears in the above-identified patent and that said Letters Patent is hereby corrected as shown below:

IN THE SPECIFICATION:

Column 2, Line 52 - "space" should be -- spaced -- .

IN THE CLAIMS:

Substitute the following for Claim 1 in the patent:

In a color picture tube having a faceplate panel with a curved faceplate contour including a similarly contoured slit type apertured mask mounted within said panel, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, said columns extending vertically when said tube is in an operational orientation, the improvement comprising the aperture throat columns passing through a center portion of said mask being substantially straight and the aperture throat columns on both sides of the center portion of the mask being convexly curved toward said center portion and increasing in curvature with increasing distance from the center portion.

UNITED STATES PATENT AND TRADEMARK OFFICE
CERTIFICATE OF CORRECTION

PATENT NO. : 4,665,339

DATED : May 12, 1987

INVENTOR(S) : Walter David Masterton et al.

It is certified that error appears in the above-identified patent and that said Letters Patent is hereby corrected as shown below:

Substitute the following for Claim 4 in the patent:

In a color picture tube having a faceplate panel with a curved faceplate contour including a similarly contoured slit type apertured mask mounted within said panel, said mask having a major axis and a minor axis, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, the improvement comprising the aperture throat columns passing through a center portion of said mask being substantially straight and substantially parallel to the minor axis and the ultimate aperture throat columns at the sides of the mask are curved being closer to the minor axis where they cross the major axis than they are at their ends.

UNITED STATES PATENT AND TRADEMARK OFFICE
CERTIFICATE OF CORRECTION

PATENT NO. : 4,665,339

DATED : May 12, 1987

INVENTOR(S) : Walter David Masterton et al.

It is certified that error appears in the above-identified patent and that said Letters Patent is hereby corrected as shown below:

Substitute the following for Claim 5 in the patent:

In a color picture tube having a faceplate panel with a curved faceplate contour including a similarly contoured slit type apertured mask mounted within said panel, said mask having a major axis and a minor axis, apertures in said mask having larger openings at one surface of said mask and smaller openings at the other surface of said mask, the narrowest restriction in each aperture being the throat of the aperture, wherein the aperture throats are arranged in columns and the apertures within each column are separated by webs, the improvement comprising the centerline-to-centerline spacing between the last two adjacent aperture throat columns at a side of the mask being less where the columns cross the major axis than at their ends.

Signed and Sealed this

Twenty-eighth Day of June, 1988

*Attest:*

*Attesting Officer*

DONALD J. QUIGG

*Commissioner of Patents and Trademarks*